United States Patent [19]

Anderson et al.

[11] 4,185,554

[45] Jan. 29, 1980

[54] SWEEPING ACOUSTIC MINES

[75] Inventors: Richard K. Anderson; Frederick A. Rohrman, both of Panama City, Fla.

[73] Assignee: The United States of America as represented by the Secretary of the Navy, Washington, D.C.

[21] Appl. No.: 46,036

[22] Filed: Jul. 28, 1960

[51] Int. Cl.[2] ..... B63G 7/02

[52] U.S. Cl. ..... 102/18 MS

[58] Field of Search ..... 114/235, 235.2, 240, 114/240.1, 221, 221.1; 102/10, 15, 17, 18, 19.2, 22, 23; 89/1 A

[56] References Cited

U.S. PATENT DOCUMENTS

| | | | |
|---|---|---|---|
| 2,353,360 | 7/1944 | Ronning | 89/1 A |
| 2,397,209 | 3/1946 | Schaelchlin | 114/221 |
| 2,475,875 | 7/1949 | Burrows et al. | 102/22 |
| 2,725,821 | 12/1955 | Coleman | 102/22 |
| 2,726,602 | 12/1955 | Davis et al. | 102/29 |
| 2,967,506 | 1/1961 | Livermore | 89/1 A |

*Primary Examiner*—Charles T. Jordan

*Attorney, Agent, or Firm*—Louis A. Miller; Rolla N. Carter

EXEMPLARY CLAIM

1. An explosive assembly for producing an acoustic signature for minesweeping when detonated under water comprising a flexible line, explosive charges secured to said line at spaced points along the length of said line, the explosive content of said charges varying by increments from a minimum to a maximum at a substantially constant rate, the overall assembly having a weight-in-water so distributed that when the assembly is unrestrained in water the force of gravity places all segments of said line under tension, and means for firing said charges in rotation in the order of their ascending magnitude of explosive content, said charges being so spaced and distributed along said line that the combination of the spacing and the firing sequence renders said charges separate charges.

2 Claims, 4 Drawing Figures

SWEEPING ACOUSTIC MINES

The invention described herein may be manufactured and used by or for the Government of the United States of America for governmental purposes without the payment of any royalties thereon or therefor.

The present invention relates to underwater acoustics and more particularly to simulating the underwater sound produced by a ship underway for the purpose of sweeping acoustic influence mines.

A ship sailing through a seaway introduces into the water a multiplicity of sounds which more or less includes all the spectrum from below 5 cycles to above 40 kilocycles per second. The variation in intensity of the sound received at a fixed point on the seabed as a ship approaches, passes over and recedes from said fixed point is referred to as the ship's acoustic signature. There are several properties of a ship's acoustic signature which are or can be made use of in detecting the passage of a ship and, to the extent practical, in discriminating against other sources of acoustic energy. These properties include the spectral distribution of the acoustic energy radiated by the ship over the entire frequency range for which detection against the ambient background level is feasible, the time rate of change of the apparent intensity of the sound energy due to the motion of the ship as it approaches and passes the mine, and the direction of arrival of the sound energy which is a direct indication whether or not the sound source lies within the damage cone of the mine and the range of the source. An ideal sweep gear, accordingly, would be one which simulates over as large a distance as possible all of the properties available to the sensing mechanism of the mine. Happily, for practical reasons a mine designer does not attempt to make use of all of these properties which in turn relaxes considerably the requirements of a practical sweep.

The primary object of the invention is to generate underwater sound which to a mine mechanism simulates the underwater sound of a ship passing within the damage area of a mine.

Another object of the invention is the provision of an underwater sound source of the explosive type which is compactly packaged prior to being placed in use.

Still another object of the invention is the provision of a high intensity sound source for sweeping acoustic mines which is inexpensive enough to be expendable.

Other objects and advantages of the invention will become apparent from the following description of a preferred embodiment thereof and its mode of operation.

In accordance with the preferred embodiment of the invention, the foregoing objects are accomplished by providing an array of a plurality of individually packaged explosive charges of varying explosive content connected at points along the length of a flexible line and spaced therealong to constitute separate charges, i.e., to prevent sympathetic detonation. Each separate charge has individual thereto a detonator having a built-in unique delay time with the delay times increasing progressively with increased explosive content of the several charges, the arrangement being such that in use the charges are detonated in ascending order of magnitude at substantially equal intervals of time, say ½ second, and for a total duration of firing of say approximately 14 seconds. It has been found that several known mine mechanisms will be actuated if the sound level increase between successive detonations is approximately 1 decibel, the interval between detonations is approximately ½ second, and the number of successive detonations is at least 20. Ordinarily, an acoustic mine is provided with an anticountermine (ACM) mechanism which discriminates against noise fields in which the rate of change is too high to have been produced by a ship traveling at speeds expected of target ships. This is to reduce the vulnerability of the mine to explosive sweeping.

Also in accordance with the invention the explosive content of each of the explosive charges is subdivided into separate charges, these subdivided charges being fired substantially but intentionally not quite simultaneously so as to produce a "mushy" explosion which reduces concussion and is less likely to actuate an ACM circuit. The lack of coincidence in firing these subdivided charges can be accomplished by utilizing delay electric blasting caps having the same nominal delay time but if necessary manufactured with a deliberate lack of preciseness.

In practice, the charges of such an array are released into the water in sequence from a moving ship or aircraft so that they string out to insure being properly spaced in the water. The timing of the several explosions is preferably such that they take place substantially at or near the bottom but in any event are submerged to a depth such that none of the bubbles produced by the explosions breaks the water surface during its first oscillation. The fastening of the charges along a line is merely one convenient way of obtaining the desired separation of the charges and of course the desired separation may be accomplished in other ways such as dispersing unconnected charges widely enough to prevent sympathetic explosions.

The invention will be better understood from the following description when read in connection with the accompanying drawing in which.

Figure 1:
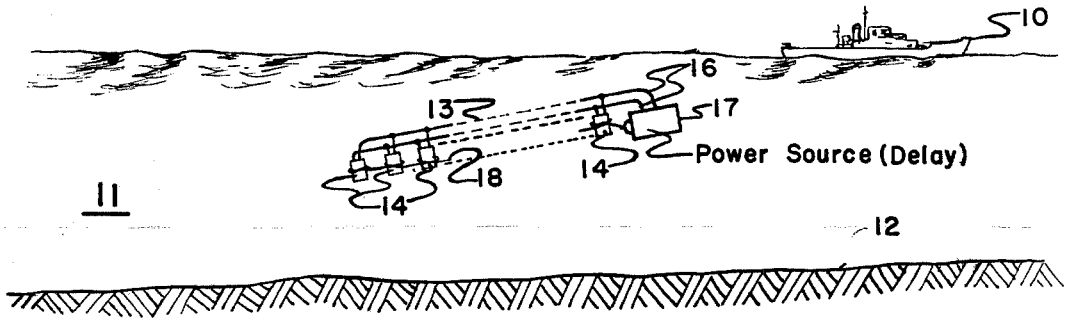
FIG. 1 is a conventionalized showing of the use of the invention in a minesweeping operation.
Figure 2:
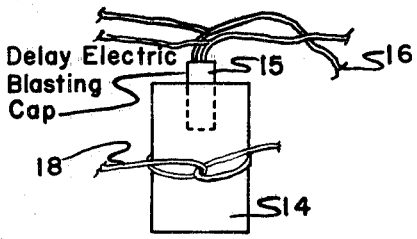
FIG. 2 shows a representative charge.

The operation illustrated in FIG. 1 comprises a minesweeping vessel 10 underway in a body of water 11 having a bottom 12 which may have deposited thereon acoustic influence mines which in accordance with the invention are about to be swept by an explosive array 13 which has recently been released from the ship 10 and is descending towards the bottom 12. The array 13 comprises a plurality of small metal cans 14 having delay electric blasting caps 15 connected through leads 16 to be fired by a power source 17 after a delay time chosen to permit the array 13 to sink to or near the bottom 12 before being detonated. The cans 14 are tied together in series and to the power source 17 by a line 18 and are spaced along the line 18 at distances great enough to prevent sympathetic detonation during firing, i.e., the charges are separate. The charges individually packaged in the cans 14 are of varying explosive content and their associated delay electric blasting caps 15 have built-in unique delay times so that the charges are detonated in ascending order of magnitude to thereby simulate the portion of a ship's acoustic signature to which acoustic mines are responsive.

Figure 3:
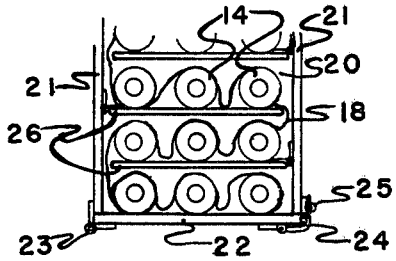
FIG. 3 illustrates one suitable packaging arrangement of the array of the invention.
Figure 4:
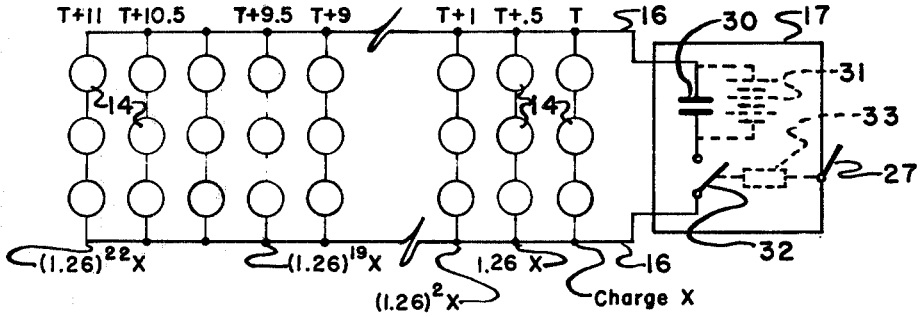
FIG. 4 shows schematically an electric firing diagram of several charges having different delay times.

The canned charge 14 arrayed on their connecting line 18 may be suitably packaged in a container which permits easy handling and from which the array can be dispensed with a minimum probability of the array becoming entangled. FIG. 3 is a fragmentary showing of a container and packaging arrangement found to be suitable. As here shown, the container comprises a box-like structure having a bottom wall 20, vertical side walls 21 and an end wall 22 connected by a hinge 23 to one of the side walls 21 and detachably secured to one of the other side walls 21 by a hasp 24, the hasp 24 being adapted to be passed over a staple 25 and secured by a pin not shown. The cans 14 are retained in rows by shelves 26, alternate ones of which are hinged to opposite side walls 21 with the connecting line 18 passing around the free ends of the shelves 26 whereby when the end wall 22 is released the cans 14 will stream out serially without becoming entangled. The firing leads 16 have been omitted from the showing in FIG. 3 to avoid clutter. It is preferable to package the power source 17 in the container of FIG. 3 so that it will be the last to be dispensed at which time its toggle switch 27 (FIG. 4) is thrown thereby minimizing any damage resulting from a misfire.

In accordance with the invention, the explosive content of each of the stepped charges is equally distributed among several charges, preferably three, with their associated firing devices having the same nominal delay time with the expectation that they will not fire at precisely the same time so as to reduce concussion and to bring about some blending of the detonation of one group into the next thereby reducing ACM peaks. One distribution of charges found to be satisfactory is shown schematically in FIG. 4 which is a series parallel firing arrangement in which each series group consists of three containers 14 having equal explosive content and the same nominal delay. As here indicated, the cans 14 having the largest explosive content are the farthest removed from the delay power source 17 so that they will be dispensed first and hence will normally be under water when the delay firing switch 27 is thrown. Also, the time of delay of the blasting caps are preferably made to increase correspondingly with increase in explosive content. Thus, the cans 14 with the smallest charge x are indicated as having instant firing blasting caps which fire at time T equal to the delay introduced in the power source 17 after the toggle switch 27 has been thrown. The second series group having a charge of say 1.26x fires at T+0.5 seconds; the third series group having a charge $(1.26)^2x$ fires at T+1 second and so on with the 23d and last series group having a charge content of $(1.26)^{22}x$ fired at T+11 seconds. It is thus apparent that the charges in the cans 14 are detonated in ascending order of magnitude at equal intervals of time of nominally ½ second and that adjacent series of charges increase in explosive content by a factor of 1.26 which provides a sound level increase between successive detonations of approximately 1 decibel. If the unit charge x is equivalent to 1.5 grams of TNT, the three cans 14 in the T+11 seconds series will each contain approximately 240 grams of TNT, it being understood that these figures are exemplary only. The handling, arming and firing of the array and the necessary precautions to be taken in so doing are well known to those skilled in the blasting art and need not be here recited. The power source 17 may be any well known type, one of which is functionally indicated in FIG. 4 as comprising a condenser 30 connected to be charged by a battery 31 and to be discharged into the firing lines 16 through a switch 32 which is adapted to be closed through a delay train 33 T seconds after the toggle switch 27 is thrown.

For convenience in packaging and handling as well as to make it simpler to design machine launching equipment the charge containers 14 are preferably all of equal dimensions, their explosive content being clearly indicated as by suitable color coding. Wadding in the cans 14 for holding the explosive charge in detonating relation with the blasting cap 15, and/or its booster charge, is chosen to have a density which when packed will regulate the weight in water of the cans to substantial equality to assure that the sinking rates of the individual cans do not differ sufficiently to cause bunching of the array.

While for the purpose of disclosing the invention to enable those skilled in the art to construct the apparatus and practice the method of the invention, a preferred embodiment has been described in detail it is to be understood that the invention is not limited thereto but is of the scope of the appended claims.

What is claimed is:

1. An explosive assembly for producing an acoustic signature for minesweeping when detonated under water comprising a flexible line, explosive charges secured to said line at spaced points along the length of said line, the explosive content of said charges varying by increments from a minimum to a maximum at a substantially constant rate, the overall assembly having a weight-in-water so distributed that when the assembly is unrestrained in water the force of gravity places all segments of said line under tension, and means for firing said charges in rotation in the order of their ascending magnitude of explosive content, said charges being so spaced and distributed along said line that the combination of the spacing and the firing sequence renders said charges separate charges.

2. An explosive assembly according to claim 1 in which at least the charge having the maximum explosive content consists of at least two separate charges which have individual firing devices having the same nominal delay time.

* * * * *